US009556680B2

(12) United States Patent
Dirksen et al.

(10) Patent No.: US 9,556,680 B2
(45) Date of Patent: Jan. 31, 2017

(54) SINGLE TRIP LINER SETTING AND DRILLING ASSEMBLY AND METHODS

(75) Inventors: Ronald Johannes Dirksen, Spring, TX (US); James H. Dudley, Spring, TX (US); Kenneth D. Caskey, Frisco, TX (US); Joseph D. Parlin, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 226 days.

(21) Appl. No.: 14/005,731

(22) PCT Filed: Mar. 2, 2012

(86) PCT No.: PCT/US2012/027459
§ 371 (c)(1),
(2), (4) Date: Sep. 17, 2013

(87) PCT Pub. No.: WO2012/134705
PCT Pub. Date: Oct. 4, 2012

(65) Prior Publication Data

US 2014/0041881 A1 Feb. 13, 2014

Related U.S. Application Data

(60) Provisional application No. 61/468,001, filed on Mar. 26, 2011.

(51) Int. Cl.
*E21B 7/20* (2006.01)
*E21B 23/00* (2006.01)
*E21B 43/10* (2006.01)

(52) U.S. Cl.
CPC ..... *E21B 7/20* (2013.01); *E21B 23/00* (2013.01); *E21B 43/10* (2013.01); *E21B 43/105* (2013.01)

(58) Field of Classification Search
CPC ..... E21B 43/103; E21B 43/108
See application file for complete search history.

(56) References Cited

U.S. PATENT DOCUMENTS

| | | | | |
|---|---|---|---|---|
| 5,472,057 | A | 12/1995 | Winfree | |
| 2005/0263294 | A1* | 12/2005 | Braddick | E21B 43/106 166/382 |
| 2007/0267221 | A1* | 11/2007 | Giroux et al. | 175/57 |
| 2009/0090508 | A1 | 4/2009 | Brouse | |

FOREIGN PATENT DOCUMENTS

| | | | |
|---|---|---|---|
| GB | 2438508 | A | 11/2007 |
| WO | 2004/072434 | A2 | 8/2004 |

OTHER PUBLICATIONS

International Preliminary Report on Patentability, International Application No. PCT/US2012/027459, mailed Oct. 10, 2013, 8 pages.
International Search Report and Written Opinion, International Application No. PCT/US2012/027459, 13 pgs., Feb. 22, 2013.

* cited by examiner

*Primary Examiner* — Catherine Loikith
(74) *Attorney, Agent, or Firm* — Alan Bryson; Baker Botts L.L.P.

(57) ABSTRACT

A liner assembly (100) includes a drill string (120) to drill a borehole (105) in a formation (110). The liner assembly further includes a liner assembly releasably coupled to the drill string to move with the drill string in the borehole while the drill string drills, and to be released from the drill string in the borehole after the drill string drills to a depth.

17 Claims, 3 Drawing Sheets

SINGLE TRIP LINER SETTING AND DRILLING ASSEMBLY AND METHODS

CROSS-REFERENCE TO RELATED APPLICATIONS

This application is a U.S. National Stage Application of International Application No. PCT/US2012/027459 filed Mar. 2, 2012, which claims the benefit of U.S. Provisional Application No. 61/468,001, which was filed Mar. 26, 2011, and which are hereby incorporated by reference in their entirety.

BACKGROUND

The present disclosure relates generally to equipment utilized and operations performed in conjunction with a subterranean well and, more particularly, to a single trip liner setting and drilling assembly.

Liner hangers may provide the functions of sustaining the weight of the liner below and isolating pressure differentials above and below the liner. Certain conventional liner running methods require drilling through the reservoir, often inducing losses in the depleted interval, then pulling out of the hole and finally running the liner again risking losses. In view of drilling and completion costs, efficient approaches to drilling and completing new wells and sidetracking existing wells are desirable to decrease cost and enhance production.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to equipment utilized and operations performed in conjunction with a subterranean well and, more particularly, to a single trip liner setting and drilling assembly.

Illustrative embodiments of the present disclosure are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Devices and methods in accordance with certain embodiments may be used in one or more of wireline, measurement-while-drilling (MWD) and logging-while-drilling (LWD) operations. Certain embodiments according to the present disclosure may provide for a single trip liner setting and drilling assembly.

Figure 1:
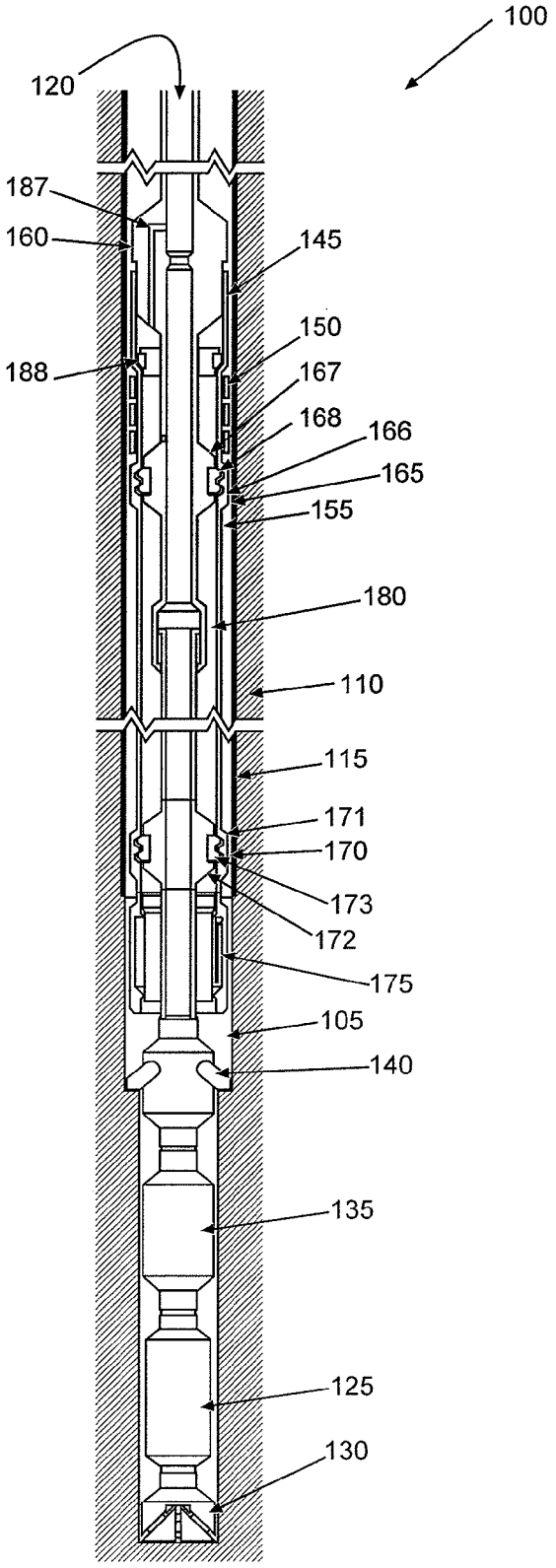
FIG. 1 is a partial diagram of a single trip liner setting and drilling assembly, in accordance with certain exemplary embodiments of the present disclosure.

FIG. 1 is a partial diagram of a single trip liner setting and drilling assembly 100, in accordance with certain exemplary embodiments of the present disclosure. As depicted, the assembly 100 extends into a formation 110 and is disposed in a new borehole 105 being drilled. A casing 115 may extend through a portion of the borehole 105, forming an annulus therein. The casing 115 may be a standard casing, may be made from any suitable material (which may include metals, plastics, composites, etc.), may be expanded or unexpanded as part of an installation procedure, and/or may be segmented or continuous.

The single trip liner drilling assembly 100 may include a drill string 120, which may include one or more tubular sections (e.g., a drill pipe assembly) and a bottom hole assembly 125 disposed below the casing 115 for drilling new portions of the borehole 105. The bottom hole assembly 125 may have a drill bit 130 coupled to at least one of a sensor and a drill pipe of the bottom hole assembly 125 on its lower end for drilling the borehole 105. Certain embodiments may employ a drill string 120 having a bottom hole assembly 125 and a drill bit 130 at end thereof that is rotated by a drill/mud motor (not shown) and/or the drill string 120. A number of downhole devices may be placed in close proximity to the drill bit 130 to measure certain downhole operating parameters associated with the drill string 120. In certain embodiments, such devices may include sensors for measuring downhole temperature and pressure, azimuth and inclination measuring devices and a resistivity-measuring device to determine the presence of hydrocarbons and water. The drill string 120 may utilize a drilling fluid to pass down the flowbore of the drill string 120 and through the drill bit 130. The returns then may pass up the annulus formed between the drill string 120 and borehole wall and the casing 115.

The bottom hole assembly 125 may further include a measuring-while-drilling (MWD) and/or logging-while-drilling (LWD) section 135, and pulsers may be designed so as not to be susceptible to cement entrapment. It should be understood that the bottom hole assembly 125 may include other sections not shown such as a rotary steerable tool, a drive sub, a telemetry sub, etc. Other drilling tools that may be included in various embodiments may also be designed so as to not be susceptible to cement entrapment and/or the tools may be designed to allow for mitigation of cement entrapment after the process is complete.

The bottom hole assembly 125 may further include a reamer 140 installed to follow the drill bit 130 through the borehole 105. The reamer 140 may be an underreamer, a winged reamer, any standard concentric reamer as used in many applications in industry, or any suitable reamer tool to enlarge the borehole 105, ensuring that it will have an adequate diameter. The reamer 140 may include retractable reaming arms that may be deployed for remaining and retracted to facilitate movement through smaller diameters. The reamer 140 may be designed to not be susceptible to cement entrapment.

Disposed above the drilling and reaming portions of the assembly 100 may be a liner string 145. The liner string 145 may include a liner hanger 150 and a liner 155. The liner hanger 150 may be used to seal and secure an upper end of the liner 155 near a lower end of the casing 115 or any suitable location. The liner hanger 150 may be threadably coupled to, integral with, matingly engaged to, or otherwise coupled to the liner 155 in any suitable manner. The liner 155 may include a conventional liner system or any suitable liner tubular or tubular system. The liner string 145 and casing 115 may be made from any suitable material (which may be metals, plastics, composites, etc., depending on the desired implementation) and may be segmented or continuous.

The liner string 145 may be expanded or unexpanded as part of an installation procedure. In certain embodiments, the liner hanger 150 may be an expandable liner hanger, and the liner hanger 150 may include a plurality of expandable elements. In one non-limiting example, the liner hanger 150 may be a VersaFlex® Liner Hanger available via Halliburton Energy Services, Inc.

The assembly 100 may include a liner hanger setting tool 160 configured to set the liner hanger 150. The setting tool 160 may be coupled to the drill string 120 via a threaded connection or in any suitable manner. As depicted, the setting tool 160 may sealingly engage an interior surface of the liner hanger 150. The setting tool 160 may include one or more hydraulic setting ports 187 and a setting tool piston device 188, which will be described further herein. In one non-limiting example, the liner hanger setting tool 160 may be a VersaFlex® Setting Tool available via Halliburton Energy Services, Inc. The liner hanger setting tool 160 may be conveyed with the drilling assembly 100 into the borehole. In certain embodiments, the liner hanger setting tool 160 may facilitate conveyance and installation of the liner string 145, in part by using the torque, tensile and compressive forces, fluid pressure and flow, etc.

The assembly 100 may include an upper latch device 165 and a lower latch device 170. The liner string 145 may be releasably secured to the drill string 120 by means of the latch devices 165, 170, which may be run downhole with the liner string 145. The latch devices 165, 170 may each include one or more latch couplings 166, 171, respectively. As depicted, for non-limiting example, the latch coupling 166 may be coupled to, or integral with, the liner hanger 150 and the liner 155 in the liner string 145. The latch couplings 166, 171 may be removably attached to, fixedly attached to, or formed integrally with one or more of the liner hanger 150 and the liner 155 in any suitable manner.

The latch devices 165, 170 may each respectively include one or more anchors 167, 172 coupled to the drill string 120. The anchors 167, 172 may be removably attached to, fixedly attached to, or formed integrally with the drill string 120 in any suitable manner. The anchors 167, 172 may each include one or more latch keys 168, 173, respectively. In various embodiments, one or more of the latch devices 165, 170, latch couplings, 166, 171, anchors 167, 172, latch keys 168, 173, and liner string 145 may include engaging profiles, e.g., with mating recesses and protrusions.

The upper latch device 165 and/or the lower latch device 170 may provide a means of operatively engaging the liner string 145 and permitting transfer of suitable axial and/or rotation forces between the drill string 120 and the liner string 145. The upper latch device 165 and/or the lower latch device 170 may be used during the main drilling process so that the liner string 145, being secured to the drill string 120, may be carried along with the drill string 120 downhole. Thus, the drill string 120 may be used to convey the setting tool 160 and liner string 145 into the borehole 105, and may be used to conduct fluid pressure and flow, transmit torque, tensile and compressive force, etc. And the upper latch device 165 and/or the lower latch device 170 may be used so that only a certain portion of the assembly 100 needed for drilling protrudes out of the bottom of the casing 115. Additionally, the latch devices 165, 170 may allow full bore access through the liner string 145 for further operations downhole.

Figure 2:
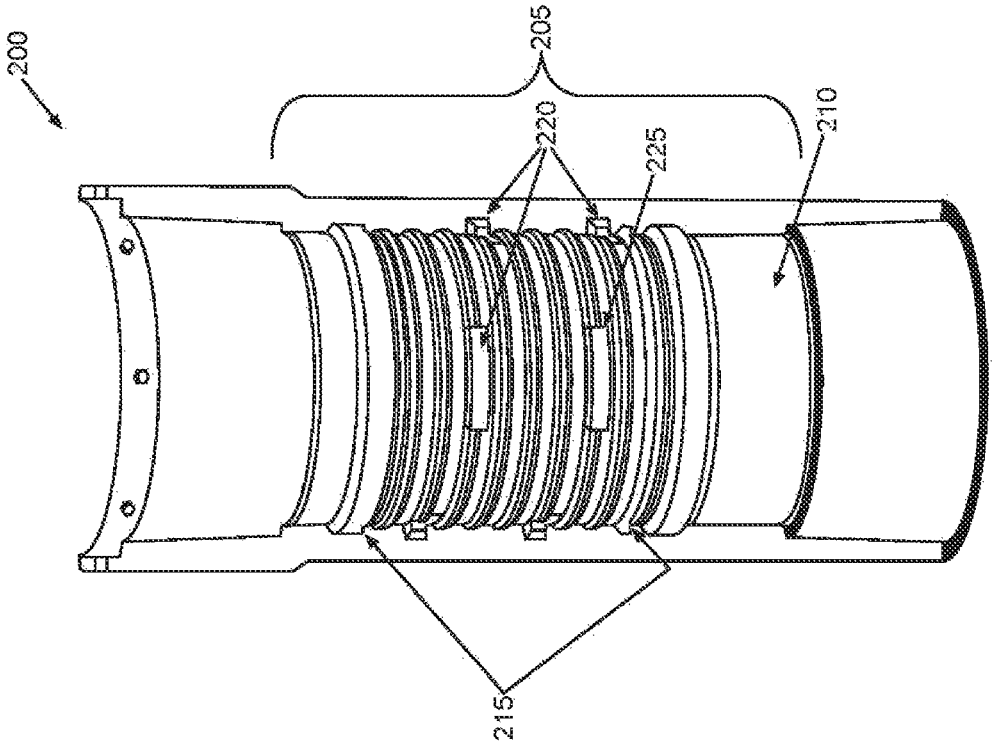
FIG. 2 is a cross-sectional view of one example latch coupling, in accordance with certain embodiments of the present disclosure.

FIG. 2 is a cross-sectional view of one example latch coupling 200, in accordance with certain embodiments of the present disclosure. The latch coupling 200 may correspond to one or more of latch couplings 166, 171 in certain embodiments, and the latch coupling 200 may be adapted to prevent a corresponding one of the anchors 167, 172 from passing further downhole when the anchor is in one or more specific orientations. The latch coupling 200 may include one or more grooves 205 on an interior portion 210. One or more of the grooves 205 may have a shoulder 215 formed to prevent a corresponding one of the anchors 167, 172 from passing further downhole when the anchor is in one or more specific orientations. By way of non-limiting example, the shoulder 215 may include a face facing uphole or substantially uphole along a longitudinal axis of the latch coupling 200 and may include a square form or a substantially square form.

The latch coupling 200 may include one or more pockets 220 on the interior portion 210. The one or more pockets 220 may be formed for mating engagement with one or more lugs of the latch keys 168, 173. By way of non-limiting example, a given pocket 220 may include one or more shoulders 225 having one or more surfaces that are formed to engage a given lug and that are more or less radial and/or square. Once engaged, forces, which may include torque, may be transferred between a given pocket 220 and a corresponding lug of a given latch key. Certain embodiments of latch key lugs are described in reference to FIG. 3.

Figure 3:
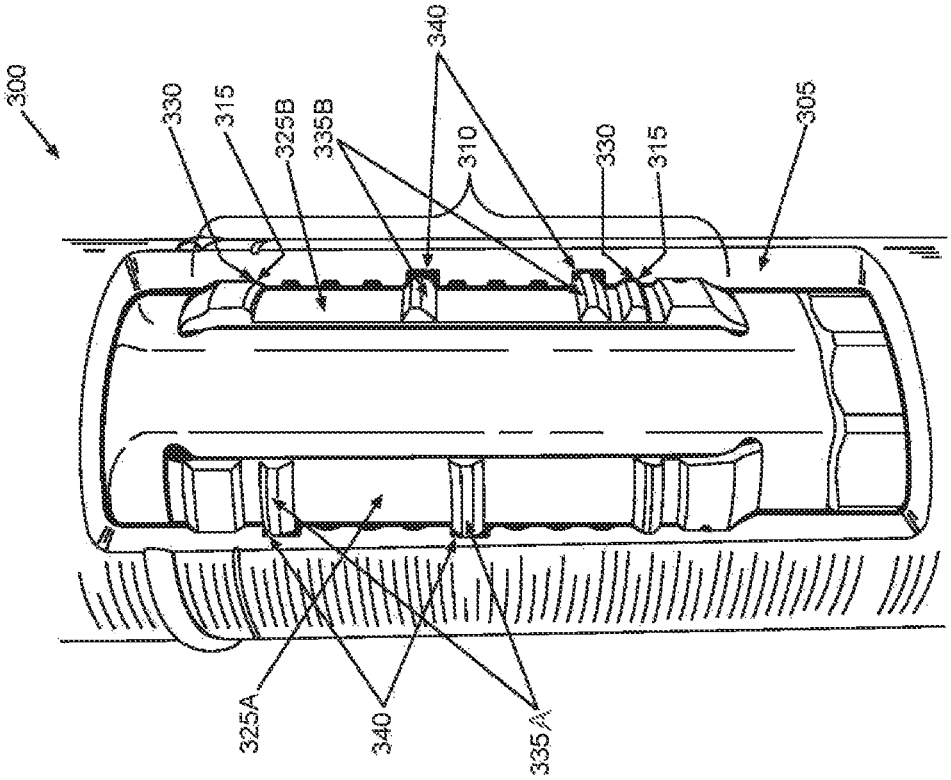
FIG. 3 is a partial cutaway view of a latch device, in accordance with certain embodiments of the present disclosure.

FIG. 3 is a partial cutaway view of a latch device 300, in accordance with certain embodiments of the present disclosure. The latch device 300 may be one exemplary embodiment corresponding to the latch device 165. The latch device 300 may include a latch coupling 305, depicted with a portion removed for illustration. The latch coupling 305 may include one or more grooves 310 on an interior portion, the grooves 310 having one or more shoulders 315. The latch coupling 305 may also include one or more pockets 340 on an inner surface. The pockets 340 may a The latch device 300 may include one or more anchors. An anchor 320 is shown in the cutaway view of FIG. 3. The anchor 320 may include one or more latch keys. Latch keys 325A and 325B are shown in the cutaway view of FIG. 3. In certain embodiments, one or both latch keys 325A and 325B may be spring-loaded and adapted to recede into the anchor 320 when under suitable compression. Considering the latch key 325B as an example, the latch key 325B may include one or more shoulders 330 corresponding to one or more shoulders 315 of the latch coupling 305. The shoulders 315, 330 may be formed to matingly engage when in one or more particular orientations. The shoulders 315, 330 may include opposing surfaces to prevent axial movement between the anchor 320 and the latch coupling 305. With the shoulders 315, 330 engaged in the one or more particular orientations, the anchor 320 may be prevented from moving axially with respect to the latch coupling 305. Conversely, when the shoulders 315, 330 are not engaged and thus not in the one or more particular orientations, the shoulders 315, 330 may not prevent the anchor 320 from moving axially with respect to the latch coupling 305. In certain embodiments, the shoulders 315, 330 may include corresponding square forms or substantially square forms.

The latch key 325B may include one or more lugs 335B. In certain embodiments, the lugs 335B may be in unique positions relative to other latch keys. For example, as depicted, the lugs 335B are at different axial positions relative to the lugs 335A of the latch key 325A.

The one or more pockets 340 may be formed for mating engagement with one or more lugs 335A, 335B. By way of non-limiting example, a given pocket 340 may include one or more radial or substantially radial surfaces formed to engage a given lug 335B. Once engaged, forces, which may include torque, may be transferred between the given pocket 340 and the corresponding lug 335B. It should be understood that the pockets 340 and the lugs 335A, 335B may have a variety of forms in various embodiments to provide for mating engagement and to allow for force transfer.

If the latch keys 325A, 325B are not aligned with the latch coupling 305 and the pockets 340, the anchor 320, including the latch keys 325A, 325B, may be allowed to pass through the latch coupling 305. However, when the latch keys 325A, 325B are aligned with the latch coupling 305 and the pockets 340, the latch keys 325A, 325B, being spring-loaded, may expand outward to allow one or more of the shoulders 315, 330, the pockets 340, and lugs 335A, 335B to engage. One or more of the shoulders 315, 330, the pockets 340, and lugs 335A, 335B may be formed to allow disengaging rotation when the spring force on the latch keys 325A, 325B is overcome. In certain embodiments, the spring force may be variable.

The slip joint (180) is needed to allow for variation or tolerance in the space-out between the latch couplings on the liner string and the latch couplings on the drill string.

As drawn, the slip joint needs to be able to transmit torque when in the fully extended (pulling upward) direction. This will allow torque to be transmitted if the drilling BHA (125) gets stuck.

Referring again to FIG. 1, an isolation valve 175 may be installed so that, after cement emplacement, the cement may be prevented from flowing up the liner string 145 (commonly referred to as "u-tubing") due, at least in part, to the cement having a higher density than a particular drilling fluid being used. In varying embodiments, the isolation valve 175 may be disposed inside or at the end of the liner string 145. The isolation valve 175 may be an electronically controlled isolation valve and may comprise one or more isolation valves, depending on the implementation—e.g., if needed to provide more than one mechanical isolation barrier, such as one barrier inside main casing string and one inside the liner.

The drill string 120 may include a slip joint 180 disposed between the upper latch device 165 and the lower latch device 170. The slip joint 180 may allow for spacing with respect to the latches 165 and 170, and may thereby provide some spacing so that both anchors 167 and 172 may engage. Accordingly, the engaged lower anchor 172 may then have manipulation room with the slip joint 180 and upper anchor 167. The slip joint 180 may be any suitable slip joint and, for example, may be adapted based on slip joints of completion operations.

With the assembly 100, the liner string 145 may be carried along with the drill string 120 and bottom hole assembly 125 so that the liner string 145 may be positioned to line the borehole 105 as part of the initial drilling process, thereby avoiding the repeated trips downhole for liner installation. Components of the assembly 100 may accommodate extended time drilling and corresponding extended periods when drilling fluid flows therethrough without eroding tool components.

Figure 4A:
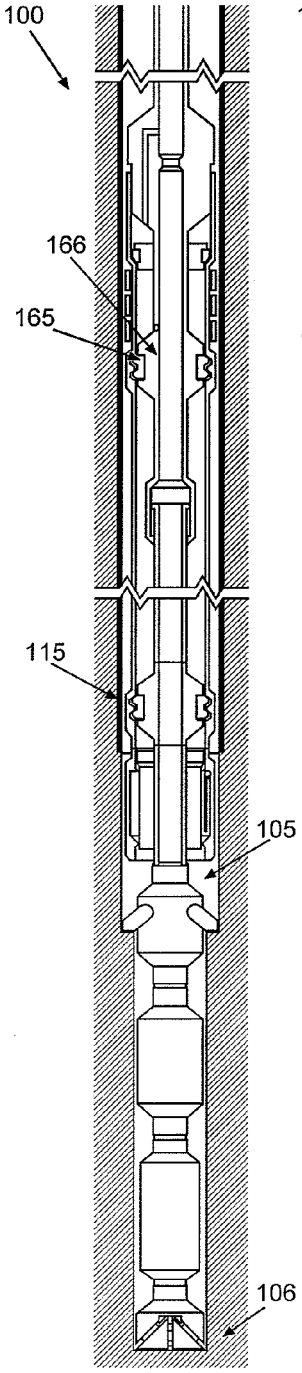
FIGS. 4A-4D show various stages of using a single trip liner setting and drilling assembly, in accordance with certain exemplary embodiments of the present disclosure.
Figure 4B:
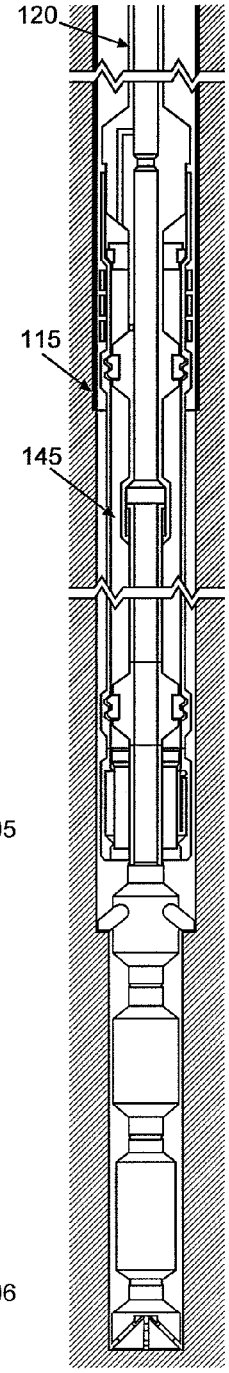

FIGS. 4A-4D show various stages of using a single trip liner setting and drilling assembly 100, in accordance with certain exemplary embodiments of the present disclosure. As part of an initial process, the assembly 100 may be run in hole, and drilling may proceed. FIG. 4A shows an initial stage with the assembly 100 disposed the borehole 105 as part of a drilling process. Drilling may proceed toward a total depth 106. However, in some instances, just prior to reaching the total depth 106, the upper latch device 165 may be unlatched, which may include the upper anchor 167 being unlatched, and drilling may then proceed to a further extent. Thus, a portion of the liner string 145 may extend further beyond the casing 115, as illustrated in FIG. 4B.

After a total depth 106 or other depth has been reached, the drilling process may be complete, and the liner string 145 may be positioned. Cement may be pumped into the borehole 105 through the drill string 120. In various embodiments, a plug/wiper system may be used with for the cement emplacement process.

After completion of cement emplacement, the liner hanger 150 may be set by using the liner hanger setting tool 160 to expand the liner hanger 150 to achieve hang-off with the casing 115 and seal the borehole annulus. For example, to actuates the setting of the liner hanger 150, an activation ball 185 or a similar activation device, such as a dart or a plug (not shown), may be released into the drill string 120 and displaced through the flow passage of the drill string 120 until it engages a seal surface/seat 186 corresponding to the liner hanger setting tool 160. Pressure may be applied to the flow passage of the drill string 120 hydraulically or in any suitable manner above the ball 185 to thereby increase a pressure differential from the flow passage to an exterior of the setting tool 160. The exterior of the setting tool 160 may correspond to the annulus between the borehole 105 (or the interior of the casing string 115) and the assembly 100.

The pressure differential may cause the setting tool 160 to begin to expand the liner hanger 150. With the activation ball 185 seated, one or more hydraulic setting ports 187 may be exposed the interior of the drill string 120 above the activation ball 185. While the non-limiting examples of the activation ball 185 or a dart are given, it should be understood that alternative embodiments may employ any suitable method, which may include using mechanical valves, such as ball/flapper valves, in lieu of controlling the one or more hydraulic setting ports 187 with the activation ball 185 or a dart.

Figure 4C:
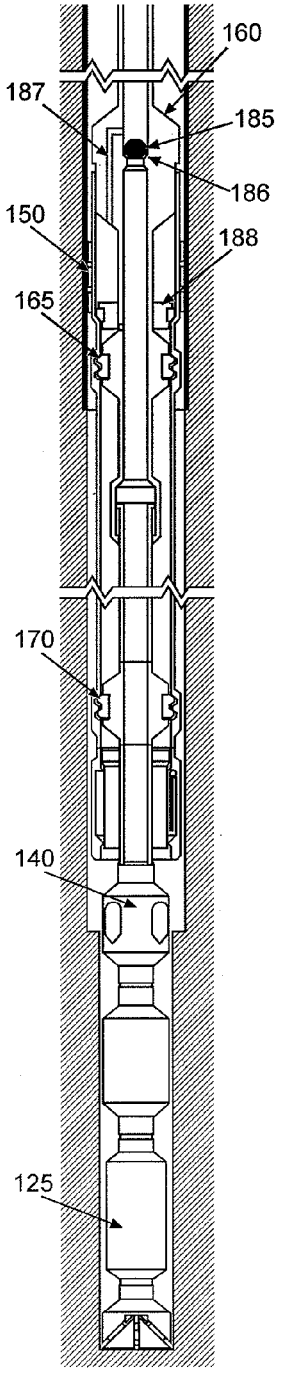

With the hydraulic setting ports 187 open, pressure may be transferred to a setting tool piston device 188 and to the interior of the setting tool 160 to generate an expansion force. With sufficient forces generated, the piston device 188 may stroke downward, allowing a surface of the piston device 188 to move down and expand a length of the liner hanger 150 until the last element of the liner hanger 150 has been expanded. This stage is illustrated in FIG. 4C. In the non-limiting example depicted, the piston device 188 includes a conical surface to expand a length of the liner hanger 150. However, in various embodiments, the piston device 188 may include any suitable surface to facilitate the expansion. Moreover, in alternative embodiments, any suitable method of provided displacement and consequent expansion of the liner hanger 150 may used, including, e.g., employing one or more of an offset cam, an offset cam configured for rotational displacement, and using one or more of weight, momentum, percussive impact, and repetitive percussive impact to provide displacement of the liner hanger 150.

Figure 4D:
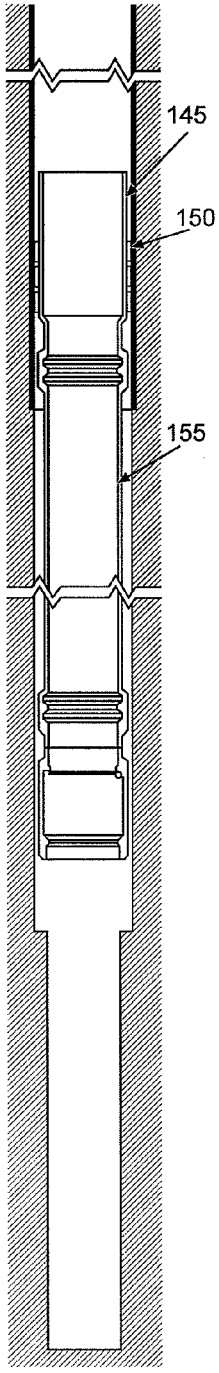

In certain embodiments, the reamer 140 may be prepared for extraction from the borehole 105 by, for example, retraction of articulating arms as depicted in FIG. 4C. With the liner string 145 set, the liner string 145 may be disengaged from the drill string 120. For example, the latch devices 165 and 170 may be unlatched. Then, the drill string 120 and other coupled components may be pulled out of the borehole 105 through the casing 115. This stage is illustrated in FIG. 4D.

In the event that cement is left in the drill string 120 and/or the bottom hole assembly 125, the drill string 120 and bottom hole assembly 125 may be pulled into the liner 155 before cement sets, and circulation may be established to flush the downhole equipment. In the event that cement "flushing" is not sufficient, certain embodiments may solve this potential problem with a "disposable" design. At this point, it should be specifically understood that the principles of the disclosure are not to be limited in any way to the details of the system and associated methods described herein. Instead, it should be clearly understood that the system, methods, and particular elements thereof (such as the liner hanger setting tool, liner hanger, liner, etc.) are only examples of a wide variety of configurations, alternatives, etc. which may incorporate the principles of the disclosure.

Accordingly, certain embodiments of the present disclosure provide for systems and methods so that the liner may be cemented soon after reaching the total depth, thus rendering a second trip for placing the liner unnecessary. Certain embodiments allow for a bottom hole assembly using a single trip liner. Certain embodiments provide for special latches installed in the casing to provide for the single-trip liner placement.

And even though the figures depict embodiments of the present disclosure in a particular orientation, it should be understood by those skilled in the art that embodiments of the present disclosure are well suited for use in a variety of orientations. Further, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning.

What is claimed is:

1. A liner assembly, comprising:

a drill string coupled to a drill bit to drill a borehole in a formation;

a latch device, wherein the latch device comprises an anchor and a latch coupling, wherein the latch coupling prevents the anchor from moving axially with respect to the latch coupling when the anchor is at a specific orientation, wherein the latch coupling comprises one or more grooves and one or more pockets on an interior portion of the latch coupling, wherein each of at least one of the one or more grooves and at least one of the one or more pockets comprises a shoulder that prevents the anchor from passing further downhole when the anchor is at the specific orientation, wherein the anchor comprises one or more latch keys, and wherein the one or more latch keys comprise one or more lugs that matingly engage with the one or more pockets to provide force transfer;

a liner assembly releasably coupled to the drill string based, at least in part, on the latch device to move with the drill string in the borehole while the drill string drills, and to be released from the drill string in the borehole after the drill string drills to a depth;

a setting tool coupled to the drill string, wherein the setting tool includes a piston movable in an axial direction with respect to a longitudinal axis of the liner assembly to expand at least a portion of the liner assembly; and a bottom hole assembly tool coupled between the liner assembly and the drill bit.

2. The liner assembly of claim 1, wherein the liner assembly comprises a liner hanger coupled to a liner.

3. The liner assembly of claim 2, wherein the liner hanger is expandable.

4. The liner assembly of claim 1, wherein the liner assembly comprises a liner hanger that is expandable.

5. The liner assembly of claim 4, wherein the setting tool comprises a port to allow expansion of the liner hanger based, at least in part, on movement of the piston.

6. The liner assembly of claim 4, wherein the setting tool allows expansion of the liner hanger based, at least in part, on displacement of a ball or a dart through the drill string.

7. The liner assembly of claim 4, wherein the setting tool sealingly engages a surface of the liner hanger.

8. The liner assembly of claim 1, wherein the latch device permits transfer of one or more of an axial force and a rotation force between the drill string and the liner assembly.

9. The liner assembly of claim 1, further comprising:

a lower latch device, wherein the liner assembly is releasably coupled to the drill string based, at least in part, on the lower latch device; and wherein the latch device is an upper latch device.

10. The liner assembly of claim 1, further comprising:

an isolation valve coupled the liner assembly to prevent cement from flowing up the liner assembly.

11. The liner assembly of claim 1, wherein the drill string comprises:

a drill bit coupled to at least one of a sensor and a drill pipe.

12. The liner assembly of claim 11, wherein the drill string further comprises:

a reamer coupled to the drill bit to follow the drill bit through the borehole.

13. A method of disposing a liner in a borehole, the method comprising:

releasably coupling a liner assembly to a drill string based, at least in part, on a latch device, the drill string coupled to a drill bit to drill a borehole in a formation;

moving the liner assembly with the drill string in the borehole while the drill string drills to a depth;

moving an anchor of the latch device to a specific orientation;

preventing, by a latch coupling of the latch device, the anchor from moving axially with respect to the latch coupling based on the specific orientation, wherein preventing the anchor from moving axially comprises:

aligning one or more pockets of the latch coupling with one or more latch keys of the anchor, wherein the latch coupling comprises one or more grooves on an interior portion of the latch coupling; and expanding the one or more latch keys to engage a shoulder of at least one of the one or more latch keys, a shoulder of at least one of the one or more grooves, one or more lugs of the at least one or more latch keys and at least one of the one or more pockets;

releasing the liner assembly from the drill string in the borehole after the drill string drills to the depth;

disposing a bottom hole assembly between the liner assembly and the drill bit; and setting the liner assembly in the borehole by expanding at least a portion of the liner assembly with a piston of a setting tool, wherein the piston is movable in an axial direction with respect to a longitudinal axis of the liner assembly.

14. The method of disposing a liner in a borehole of claim 13, wherein the step of setting the liner assembly in the borehole with the setting tool comprises:

displacing an activation device through the drill string.

15. The method of disposing a liner in a borehole of claim 13, wherein the step of setting the liner assembly in the borehole with the setting tool comprises:

opening a port to allow expansion of the liner hanger based, at least in part, on movement of the piston.

16. The method of disposing a liner in a borehole of claim 13, wherein the step of setting the liner assembly in the borehole with the setting tool comprises:

expanding an expandable liner hanger of the liner assembly.

17. The method of disposing a liner in a borehole of claim 13, further comprising:

removing the drill string from the borehole after the liner assembly is set.

* * * * *